United States Patent [19]

Burgess

[11] 4,380,398

[45] Apr. 19, 1983

[54] DISPERSION MIXER

[76] Inventor: Basil A. Burgess, 163 Bedbrook Ave., Montreal West, Quebec H4X 1R7, Canada

[21] Appl. No.: 187,709

[22] Filed: Sep. 16, 1980

[51] Int. Cl.[3] ..... B01F 7/26

[52] U.S. Cl. ..... 366/261; 366/288; 366/298; 366/309; 366/315; 366/605

[58] Field of Search ..... 366/66, 67, 102, 103, 366/198, 200, 201, 213, 217, 261, 291, 315, 297–301, 288, 309, 605

[56] References Cited

U.S. PATENT DOCUMENTS

| | | | |
|---|---|---|---|
| 1,733,516 | 10/1929 | Rodin et al. | 366/300 |
| 1,762,081 | 6/1930 | Schleicher | 366/299 |
| 2,640,688 | 6/1953 | Moller | 366/298 |
| 3,244,410 | 4/1966 | Myers . | |
| 3,342,459 | 9/1967 | Myers et al. | 366/298 |
| 3,746,267 | 7/1973 | Myers et al. | 366/299 |

FOREIGN PATENT DOCUMENTS

| | | |
|---|---|---|
| 367315 | 10/1906 | France . |
| 334213 | 11/1958 | Switzerland . |

*Primary Examiner*—Robert W. Jenkins
*Assistant Examiner*—Timothy F. Simone
*Attorney, Agent, or Firm*—Larson and Taylor

[57] ABSTRACT

A dispersion mixer is disclosed for breaking up and dispersing agglomerated particles in a liquid medium. The mixer has the capability of causing high speed particles to strike each other in such a manner as to develop their maximum shear energy potential and thus be more efficient than existing dispersion mixers. The mixer operates in a container and has a first rotor shaft extending downwards at the approximate center of the container, a second rotor shaft substantially parallel to the first rotor shaft, spaced from the first rotor shaft, at least one mixing rotor disc mounted on the first rotor shaft, and at least one mixing rotor disc mounted on the second rotor shaft, a first drive for rotating the first rotor shaft about its own axis, and the second rotor shaft about its own axis, and a second drive for moving the second rotor shaft in a circumferential path about the first rotor shaft.

4 Claims, 3 Drawing Figures

DISPERSION MIXER

The present invention relates to a dispersion mixer. More particularly the invention is directed towards a dispersion mixer of the type used to break up and disperse agglomerated particles in a liquid medium so that the particles are dispersed evenly throughout the mixture.

Dispersion mixers or dispersers for mixing particles in liquid are well known. Such mixers are used to mix paints and printing inks as well as other materials. The mixers or dispersers employ at least one high speed mixing rotor disc mounted on a rotor shaft in a mixing container. The high speed rotor discs, sometimes referred to as disperser blades, break up agglomerated particles and disperse the particles in the liquid by both mechanical shear and hydraulic shear in a high shear zone adjacent the rotor disc. The rotor discs generally have teeth on the periphery which strike the product as it passes across the rotor face preparatory to being discharged at a high velocity from the periphery of the disc. This discharge impinges on slower moving product causing a scrubbing or attrition like action as the high speed particles strike slower moving particles. In some later types of dispersion mixers, a slow speed stirrer or agitator is provided to feed the materials to the rotor disc.

In some disperser mixers the high speed rotor disc is located approximately in the center of the container, with a stirrer rotating about this high speed disc, sweeping close to the outside wall of the container itself. In other embodiments, a high speed rotor disc is positioned at one side of the container, with a low speed stirrer or agitator being axially mounted in a cylindrical container and extending radially out to the wall of the container beneath the mixing rotor disc. Examples of such mixers are shown in U.S. Pat. Nos. 3,342,459 and 4,091,463.

With a single high speed rotor disc located in one zone of a container, it is necessary to provide a stirrer or similar device to ensure that the entire contents within the container pass through the high shear zone of the rotor disc. However, the mixing action obtained from a single rotor disc does not produce the same dispersing effects as a combination of two or more rotor discs which results in some of the high speed particles ejecting from one disc to impinge on high speed particles ejecting from the other disc.

It is a purpose of the present invention to provide a more efficient dispersion mixer which has the capability of causing high speed particles to strike each other in such a manner as to develop their maximum shear energy potential. It is another purpose of the present invention to provide an improved dispersion mixer having at least two high speed rotor discs rotating on separate shafts, one shaft orbiting around the other shaft at a low speed, thus avoiding the necessity of a stirrer.

In accordance with the present invention there is provided a dispersion mixer for operating in a container, the mixer comprising a first rotor shaft extending downwards into the container at the container's approximate center, the second rotor shaft, substantially parallel to the first rotor shaft, spaced from the first rotor shaft and extending downwards into the container, at least one mixing rotor disc mounted on the first rotor shaft and at least one mixing rotor disc mounted on the second rotor shaft, first drive means for rotating the first rotor shaft about its own axis, and the second rotor shaft about its own axis, and second drive means for moving the second rotor shaft in a circumferential path about the first rotor shaft.

In embodiments of the present invention, the first and second rotor shafts rotate at substantially the same speeds and in the same direction. In another embodiment a scraper element extends downwards at the side of the container, the scraper element being moved circumferentially by the second drive means outside the circumferential path of the second rotor shaft, In drawings which illustrate the embodiments of the invention, FIG. 1 is a cross-sectional elevational view of a mixer according to one embodiment of the present invention.

Figure 2:
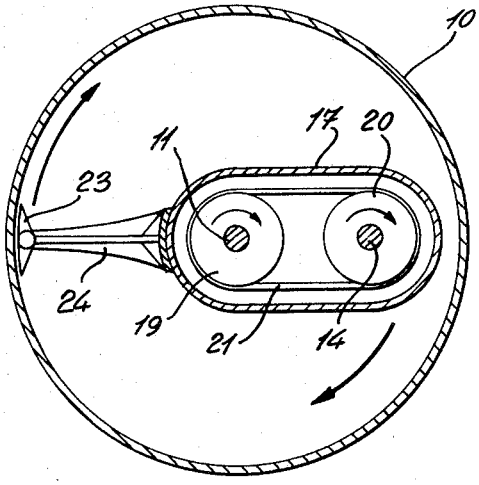
FIG. 2 is a cross-sectional plan view taken at line 2—2 of FIG. 1.
Figure 1:
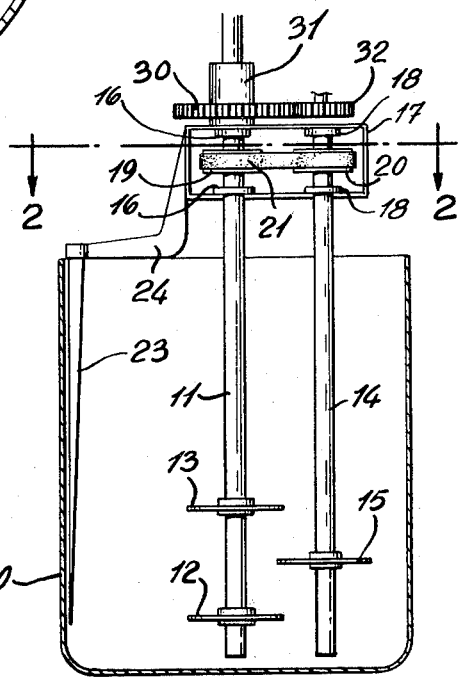

Referring to the drawings, FIGS. 1 and 2 show a cylindrical mixing container 10 with a first rotor shaft 11 extending downwards into the container 10 at its approximate center. The first rotor shaft 11 has a lower mixing rotor disc 12 on the first shaft 11 and an upper mixing rotor disc 13 spaced a predetermined distance above the lower disc 12. The rotor discs 12 and 13 are regular disperser discs, which normally have teeth at the periphery of the disc. A second rotor shaft 14 extends down into the container 10. The second shaft 14 is substantially parallel to the first shaft 11 and spaced from the first shaft 11 extending towards the side of the container 10. A mixing rotor disc 15 is positioned on the second shaft 14. As illustrated in FIG. 1, overlap may exist between the discs 12, 13, on the first shaft 11 and the disc 15 on the second shaft 14. In another embodiment, various sized discs could be used so overlap does not occur when they are in the same plane. In a further embodiment several discs are provided on each shaft. If the discs overlap, they are spaced apart vertically, if there is no overlap the discs on the two shafts may also be in the same horizontal planes.

The top of the first shaft 11 is supported by bearings 16 within a housing 17. Similarly the top of the second shaft 14 is supported by bearings 18 within the housing 17. As illustrated a pulley wheel 19 is mounted on the first shaft 11 and a second pulley wheel 20 is mounted on the second shaft 14. A belt 21 drives the pulley wheel 20 of the second shaft 14 from the pulley wheel 19 of the first shaft 11. Although one drive means is specifically illustrated herein it will be apparent to those skilled in the art that other types of drive means such as a belt, chain or gear drive may well be incorporated. As illustrated in FIG. 2 the first shaft 11 and the second shaft 14 rotate in the same direction, and as the pulleys 19 and 20 are substantially the same diameter thus the shafts rotate at substantially the same speed. By substantially the same speed is meant speed of approximately the same magnitude, although variations to suit design conditions in the drive mechanism may occur.

The scraper element 23 extends down at the side of the container 10 adjacent the wall of the container. The scraper element 23 is supported by an arm 24 connected to one side of the housing 17 such that the scraper element 23, the first shaft 11 and the second shaft 14 are substantially in a straight line. The scraper element acts as a baffle to direct the product from the side of the container into the center of the container so the product passes through the high shear zone of the rotor discs.

Figure 3:
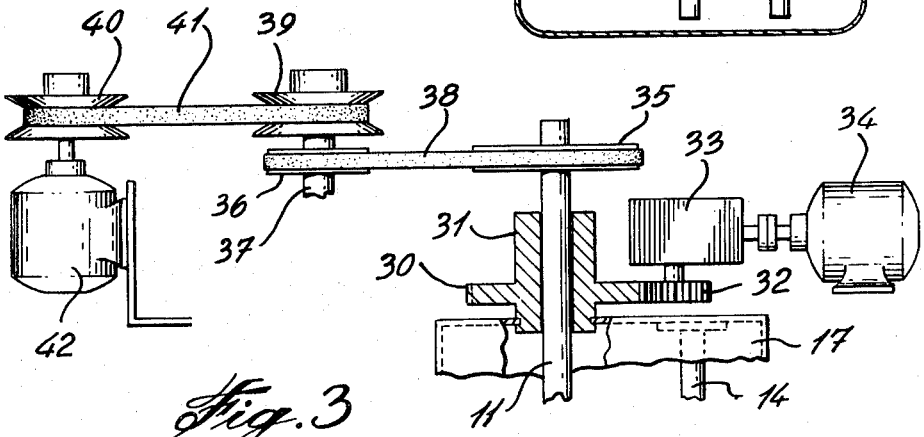
FIG. 3 is a partial elevational view of one embodiment of a suitable driving system for a mixer of the present invention.

As illustrated in FIG. 1 and in more detail in FIG. 3 a gear wheel 30 is connected to a hub 31 which fits over the first shaft 11 above the housing 17. The first shaft 11 rotates separately from the hub 31 and rotation of the shaft 11 does not effect rotational movement of the hub 31 or the gear 30. At its base, the hub 31 is keyed to the housing 17 so that rotation of the hub 31 causes the housing 17 to rotate about the first shaft 11, and the second shaft 14 moves in a circumferential path about the first shaft 11. As illustrated in FIG. 3 a second smaller gear wheel 32 meshes with gear 30 and is driven by a gear box 33 which in turn is powered by a motor 34. The motor 34 rotates the hub 31 and hence the casing 17 about the first shaft 11.

As further illustrated in FIG. 3 the first shaft 11 extends above the hub 31 and has a pulley wheel 35 mounted at the top thereof. A second pulley wheel 36 is mounted on an intermediate shaft 37 and a belt 38 extends around the pulley wheels 35,36 to drive the first shaft 11. The intermediate shaft 37 is driven by an adjustable V-belt pulley 39 mounted on the intermediate shaft 37 and a further adjustable V-belt pulley 40. A V-belt 41 extends between the two pulleys 39 and 40. Speed adjustment may be made to the adjustable pulleys 39, 40 which in turn are driven by a motor 42. Rotation of the motor 42 drives the first shaft 11 through the V-belt 41 on the adjustable pulleys 39, 40, and the belt 38 on the pulley wheels 35, 36. The second shaft 14 is rotated at substantially the same speed as the first shaft 11 by means of the belt 21 around the two pulley wheels 19, 20 within the housing 17.

The rotor shafts 11 and 14 are driven at a high speed considerably higher than the rotational speed of the housing 17 about the first shaft 11. One embodiment of the drive system for rotating the shafts is illustrated in the drawings. Other drive arrangements may include gears, chains, sprockets, or hydraulic components. Mechanical, electrical or hydraulic systems may be provided to vary shaft speeds as desired. Motor horsepowers are selected to suit the type of materials being mixed and the size of the mixer. Individual motors may be provided to drive each of the mixing rotor shafts. In the embodiment shown, both the rotor shafts 11, 14 rotate at substantially the same speed and in the same direction, such that the mixing discs 12, 13 and 15 also rotate at substantially the same speed and in the same direction. At the same time, the second rotor shaft 14 moves in a circumferential path about the first rotor shaft 11. The scraper element 23 moves at the same time directing material at the edges of the container 10 inwards towards the shear zone of the rotor disc 15 on the second shaft 14 as it rotates in the circumferential path. Some of the material dispersed from the rotor disc 15 is pushed towards the center of the container 10 and into the shear zones of the two discs 12 and 13 on the first shaft 11 to provide increased mixing. In this way the material within the container 10 is continually mixed and no zone in the container is free from the mixing action.

Various changes may be made to the mixer. As stated the number, size and position of discs on the rotating shafts may be varied, whereas two shafts have been shown this may be increased to three or more. The main concept being that a central shaft is provided and the other shafts orbit about this central shaft, while rotating about their own axis at substantially the same speed and the same direction at the central shaft. Whereas the drive for the shafts has been shown in the drawings as being a single drive, it will be apparent to those skilled in the art that an individual drive for each shaft may be provided.

The peripheral speed of the rotor discs on the shafts is preferably in the range of 3,000 to 6,000 feet per minute. The rotational speed of the shaft is selected to supply this peripheral speed range to the rotor disc. In the case of the circular movement of the second shaft about the central or first shaft, the preferred speed is between 10 and 100 rpm.

In operation, the rotor discs on the shafts rotate and a portion of the discharge from each rotor disc is directed into the discharge stream from rotors on the other shafts. In such a circulation, agglomerates and particles collide with others travelling in an opposite direction. This results in increased shear energy which not only reduces time for total mixing in the container, but permits processing of materials where the degree of energy required to break the agglomerate bonds is beyond that obtainable with existing type of dispersers. Impingement of particles and agglomerates on others moving in an opposite direction reduces flow in the area of collision if the two shafts were in fixed position relative to each other. However, as the second and, if provided, the third shaft rotate about the first shaft, low velocity material in the high shear zone is immediately and continuously swept away by the high speed movement of particles and liquid in this high shear zone.

The embodiments of the invention in which an exclusive property or privilege is claimed are defined as follows:

1. A dispersion mixer for operating in a container the mixer comprising a first rotor shaft extending downwards into the container at the container's approximate center, a second rotor shaft, substantially parallel to the first rotor shaft, spaced from the first rotor shaft and extending downwards into the container, at least one mixing rotor disc mounted on the first rotor shaft, and at least one mixing rotor disc mounted on the second rotor shaft, first drive means including first motor means for rotating the first rotor shaft about its own axis, and the second rotor shaft about its own axis, and second drive means including second motor means independent of said first drive means for moving the second rotor shaft in a circumferential path about the first rotor shaft, the first rotor shaft rotating at substantially the same rotational speed as the second rotor shaft, and in the same direction whereby the first drive means rotates the rotor shafts at high speed to develop maximum shear and the second drive means orbits the second rotor shaft about the first rotor shaft at a low speed.

2. The mixer as claimed in claim 1 including a scraper element extending downwards at the side of the container, the scraper element moved circumferentially by the second drive means outside the circumferential path of the second rotor shaft.

3. The mixer as claimed in claim 2 wherein the scraper element, the first and second rotor shafts are substantially in line, with the first rotor shaft between the scraper element and the second rotor shaft.

4. The mixer as claimed in claim 1 wherein the rotor discs have a peripheral speed in the approximate range of 3,000 to 6,000 feet per minute, and the second rotor shaft moves in the circumferential path in the approximate range of 10 to 100 rpm.

* * * * *